United States Patent [19]

Schindlmayr et al.

[11] 4,333,731

[45] Jun. 8, 1982

[54] METHOD AND APPARATUS FOR THE MANUFACTURE OF TANNED HIDES AND SKINS

[75] Inventors: Peter Schindlmayr, Rheinbach; Horst Zäpfel, Karlsruhe, both of Fed. Rep. of Germany

[73] Assignee: Arenco-BMD Maschinenfabrik GmbH, Karlsruhe, Fed. Rep. of Germany

[21] Appl. No.: 56,849

[22] Filed: Jul. 12, 1979

[30] Foreign Application Priority Data

Jul. 19, 1978 [DE] Fed. Rep. of Germany ..... 2831617

[51] Int. Cl.[3] ..... C14C 15/00; C14C 1/04; C14C 1/06; C14C 3/30

[52] U.S. Cl. ..... 8/436; 8/94.15; 8/94.17; 8/94.21; 8/94.22; 8/94.27; 8/150.5; 69/32

[58] Field of Search ..... 8/12.5, 94.27, 150.5, 8/94.17, 94.21, 94.22, 94.15; 69/32

[56] References Cited

U.S. PATENT DOCUMENTS

| | | | |
|---|---|---|---|
| 742,115 | 10/1903 | Forbes | 69/32 |
| 1,628,966 | 5/1927 | Glasel | 8/150.5 |
| 1,978,545 | 10/1934 | Merritt | 8/12.5 |
| 2,303,477 | 12/1942 | Kirby | 8/12.5 |
| 2,466,772 | 4/1949 | Kenyon | 69/201 |
| 2,622,428 | 12/1952 | Abbott | 69/32 |
| 2,653,075 | 9/1953 | Poser | 8/150.5 |
| 2,669,111 | 2/1954 | Griffin | 69/32 |
| 2,702,229 | 2/1955 | Ushakoff | 8/94.27 |
| 3,254,938 | 6/1966 | Rodriquez et al. | 8/94.27 |
| 3,414,366 | 12/1968 | Nordstrom et al. | 8/150.5 |
| 3,901,929 | 8/1975 | Cote | 8/94.27 |
| 3,960,481 | 6/1976 | Cote | 8/94.27 |

*Primary Examiner*—Maria Parrish Tungol
*Attorney, Agent, or Firm*—Craig and Antonelli

[57] ABSTRACT

A method for the wet processes in tanneries, e.g. soaking, liming, deliming, bating, pickling and tanning, wherein the liquids or solutions necessary for these processes are injected by high pressure into the hide or skin, and an apparatus for the realization of said method, wherein piston-type shooting devices are arranged in rows and a conveyor is provided receiving the hide or skin conveying it stepwise below the shooting devices and having holding-up members for pressing the hide against the shooting devices while the injection of said liquids or solutions takes place.

12 Claims, 4 Drawing Figures

METHOD AND APPARATUS FOR THE MANUFACTURE OF TANNED HIDES AND SKINS

This invention relates to a method and an apparatus for the manufacture of tanned hides and skins with the following steps of procedure the so called wet processes: soaking of the hide, liming in a concentrated alcaline solution, deliming in an acid solution, bating, for example by means of proteolytic enzymes, pickling by means of acids and salts, tanning, for example by means of trivalent chromium salts, retanning, fatliquoring of the hide and, if necessary, dyeing.

Wet processes of a tannery are effected in drum-type containers with numerous revolutions and varying reaction periods. Besides these wet processes there are also sequences of mechanical treatment by machines such as fleshing, splitting of the leather, etc. In the following the wet process steps are explained separately:

The fresh hides are conserved by salt and in this condition enter into the tannery. Salt conservation serves to extract water from the hide. This is reabsorbed during soaking, the first process effected in the tannery. Soaking is carried out in very long floats of 200–400% meaning that a quantity of water of two or four times the weight of the hide is required. After soaking, the original moisture content of the hide is nearly restored.

During the following liming process, a treatment using concentrated alkaline up to pH 14 is carried out in floats of about 150–300%, normally containing sulfide ions. During liming the hair is dissolved chemically and natural grease is saponified. Furthermore the protein of the hide is attacked and changed in its structure, and the hide is prepared (developed, disintegrated) for the leather manufacture. While the waste water from soaking is comparatively harmless and only polluted to a lesser extent with organic substances, waste water from the lime contains above all saponified grease and dissolved hair in addition to the sulfides, thus leading to a considerable chemical and biological pollution of the waste water.

After liming, the back side of the hide is cleaned mechanically of subcutaneous tissue. Then the hide is splitted, i.e. it is reduced to uniform thickness to get the so called pelt. The ensuing tanning is effected in floats between 30 and 200% in the following sequences: during deliming the alkaline hide is neutralised by adding acids and acid salts. The resulting neutral salts are washed out. During the subsequent bating process proteolytic enzymes are fed into the hide to continue changing the protein of the hide and to disintegrate it. Finally the hide is treated with acids and salts during pickling and acidified, a prerequisite for chrome tanning.

Generally chromium -III- salts are used, preserving the normally perishable hide. This stops the growth of bacteria and prevents decay processes, etc. Also chrome-tanning produces problematic waste water containing, in the first plan, trivalent chromium.

Chrome-tanning is followed by a retanning process, for which there are different formulas, to give the hide its final look. Then the hides are fatliquored one after the other at a float length of 50 to 300% and dyed if necessary. During fatliquoring the leather is given the necessary softness and flexibility. The waste water resulting also contains a high degree of organic and inorganic substances.

For several reasons the wet processes in the tannery are technically unsatisfactory. The hide must go through various steps of procedure partly realized in charges of up to 20 tons weight of hide (wet processes) and partly by individual treatment (mechanical treatments). This requires taking the charges apart, separating and aligning the hides (head and butt,) consuming time and labour. Large hides may have a surface of up to 6 square meters and weigh up to 100 kg depending on their moisture content. As transportation must be effected manually in many parts of a tannery, a corresponding number of workers is required. Because of the aggressive chemicals and the organic substances originating from the hide hygienic working conditions can hardly be provided for the operators.

It is the primary object of the invention to propose wet processes reducing manpower and improving working conditions.

According to the invention the solutions or liquids of one or more of the said procedure steps are introduced into the hide or skin by injection under high pressure, such as 50 to more than 100 bars.

With the injection provided for individual steps as well as for all steps of the procedure the floats and the rotating drums can be eliminated. For saving costs for working materials, it is important that the quantities of solutions and liquids injected into the hide do not exceed precise requirements, and workers are hardly exposed to occupational hazards common in wet processes. As injection of the hide can be carried out on continuous transportation units there is no need for manual handling. Both water consumption and waste water production are considerably reduced. As the effectiveness of the processes no longer depends on the natural penetration of liquids into the hide, other and more efficient chemicals can be used to increase economy and improve the properties of the product. Finally the procedure according to the invention renders it possible for the entire width of the hide to undergo different types of treatment. This is important because for example the structure of the back parts is completely different from that of the neck and belly parts of the hide. As tumbling by means of revolving processes is eliminated the natural fibrous structure remains intact and there is no damage to the hide.

According to a preferred embodiment of the invention injection is provided from the flesh side of the hide. In this way the grain side of the hide, so decisive for the appearance and the value of the leather, is not attacked. Moreover, during liming, the hair is attacked from the root, is loosened and removed chemically. The hair can be used for technical (production of brushes and felts) or agricultural purposes (fertilizers of lasting effect). There is no longer any pollution of waste water by protein emanating from the chemical dissolution of the hair.

As already stated, some wet processes can be integrated into the procedure according to the invention in a conventional way, particularly liming, where each tanner has his own formula. Another advantage is that the lime, no longer containing any dissolved protein, can be reused.

Moreover the invention relates to an apparatus for the realization of the procedure, embodiments of which are given below, together with the drawings.

Figure 1:
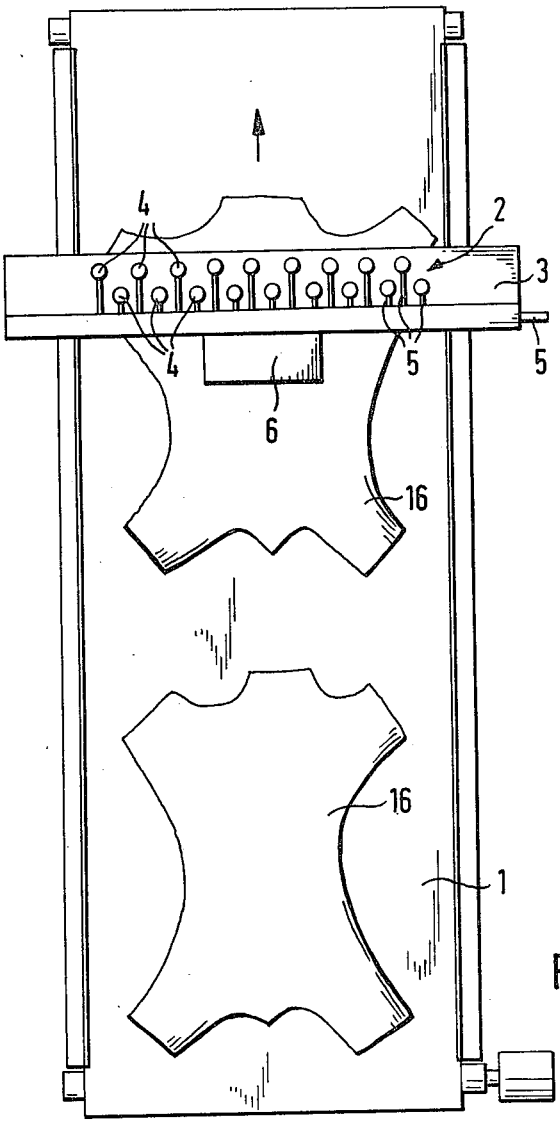
FIG. 1 is a top schematic view of a whole plant.

The apparatus essentially comprises a base (1) and an injection unit (2) arranged on a portal-like beam (3) extending over the whole width of the base. In the embodiment of FIG. 1 the base (1) is an endless stepwise driven conveyor belt and the beam is stationary. It is obvious to provide the base (1) as a stationary table and the beam (3) as a sliding carriage.

The base (1) can be made of felt, rubber or some other material of minor elasticity and can be moved over a rigid holding-up member, such as a plate, arranged at least within the area of the injection unit. The injection unit comprises several piston-type shooting devices (4) arranged in two parallel offset rows as shown in FIG. 1. The piston-type shooting devices (4) are acted upon by a pressure medium flowing through tubes (5) while injection solutions or liquids are fed to the shooting cylinders of the piston-type shooting devices from a storage bin (6) via tubes not shown in the drawing.

Figure 2:
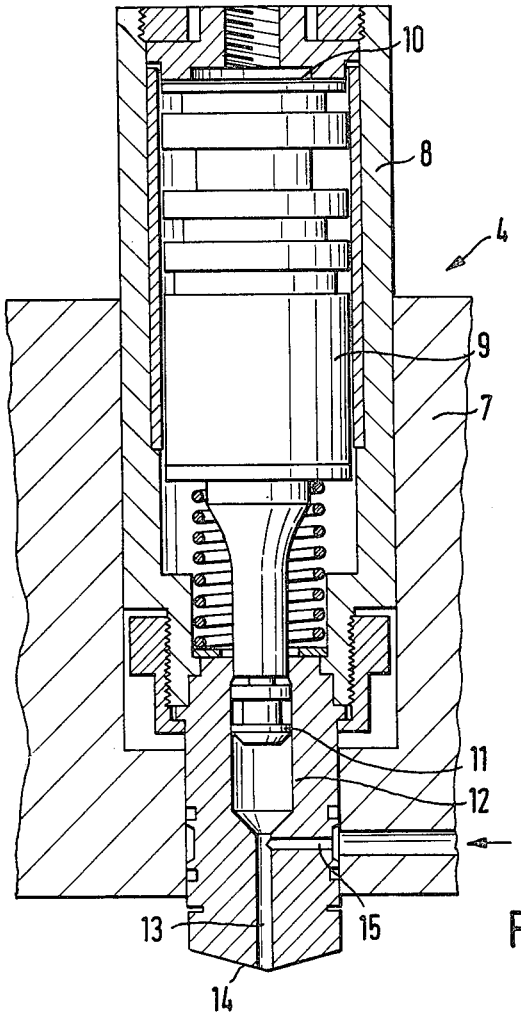
FIG. 2 is a schematic lateral sectional view of a version of the piston-type shooting unit.

FIG. 2 is a close-up view of one of the piston-type shooting devices (4) comprising a casing (7) with pressure cylinder (8) containing a piston. The pressure medium (tube 5 in FIG. 1) acts intermittently upon its one front end (10). The piston (9) extends to form a shooting piston (11) on its opposite front end, projecting into a shooting cylinder (12). The latter is tapered off to form a nozzle (13) with a convex nozzle tip (14) at the end. Channel (15) connected with a storage bin (6) (FIG. 1) enters the channel of the nozzle (13) from the side. A spring can be used to reset the shooting cylinder (11) or the piston (9).

The hides (16) are placed on the base (1) (FIG. 1) with the hair or grain side down and are stepwise moved along with the injection unit above, at a rate commensurate with the number of the rows of the shooting units on the beam (3). When the base (1) stops the injection unit (2) is lowered or the holding-up member is raised until the convex nozzle tips (14) press against the hide. Liquid is injected through all nozzles simultaneously. After the injection unit (2) has been raised or the holding-up member has been lowered, the hide is indexed one step forward and a new shooting cycle may begin.

In operation a shooting pressure of about 100 bars has proved to be optimal. Moreover, good results have been obtained with the nozzles spaced at 2 to 5 cm and a shooting volume of 0.5 ans 2 ml for each nozzle. The hide was penetrated down to its hair- or grain side and the diameter of the penetration radius was 20 to 35 mm for each nozzle.

Figure 3:
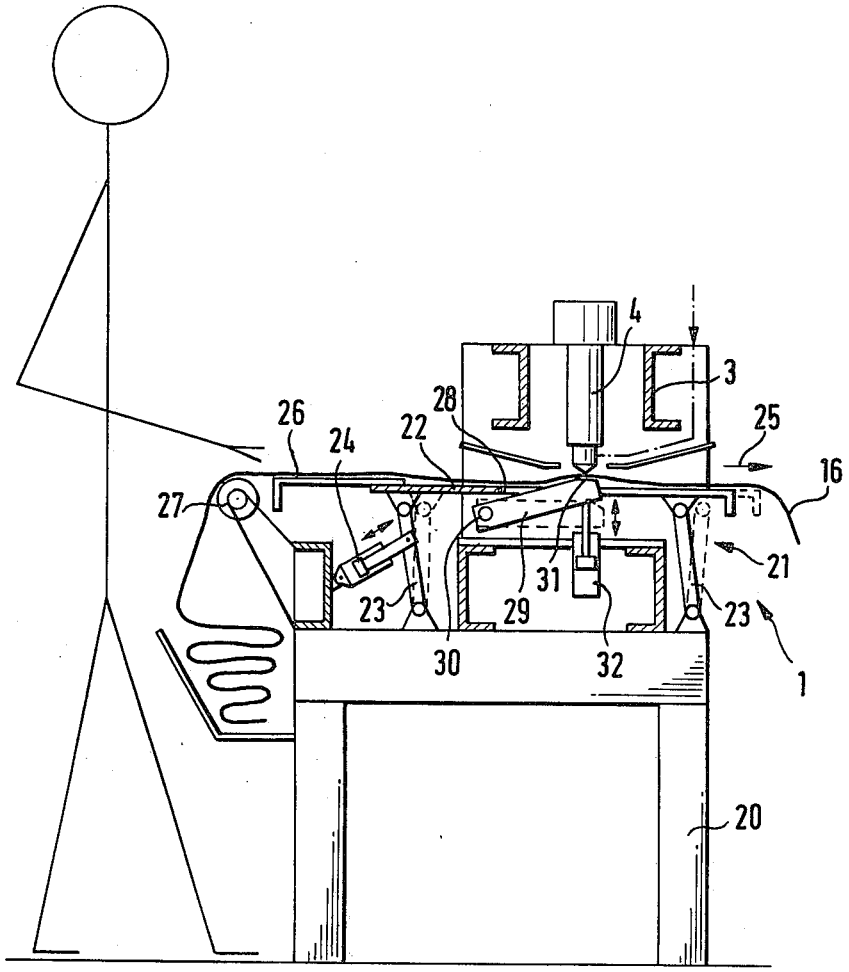
FIG. 3 is a partly broken end view of an embodiment of the plant.
Figure 4:
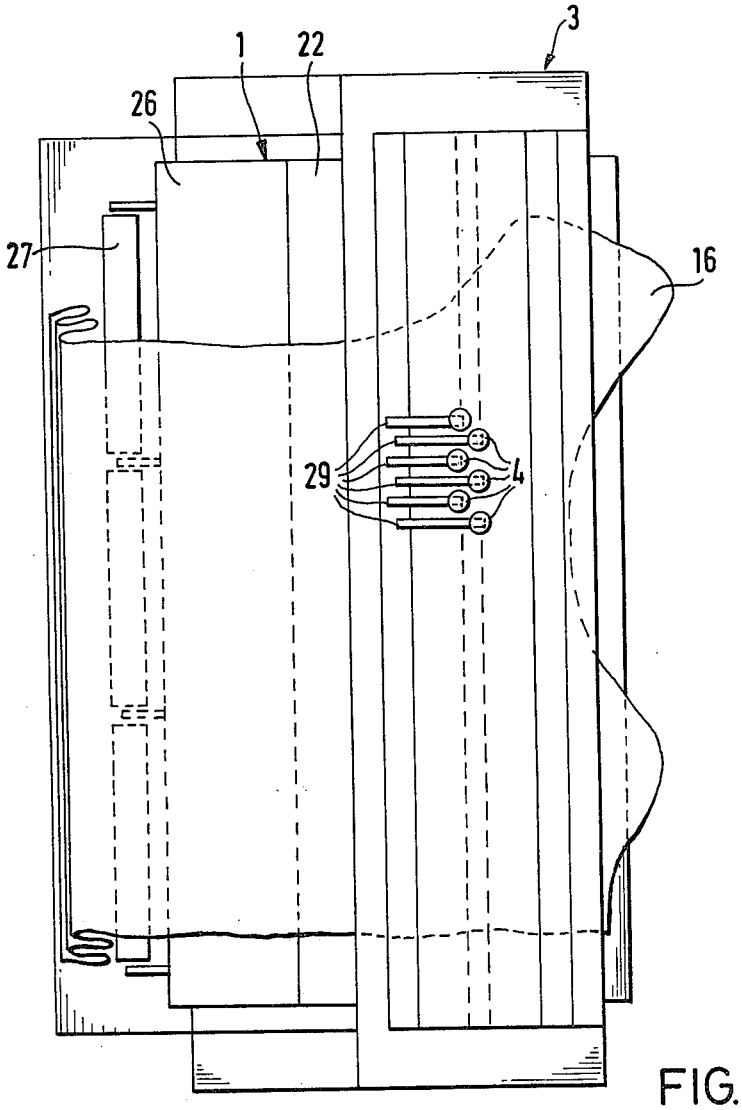
FIG. 4 is a top view of the embodiment shown in FIG. 3.

In the embodiment of FIG. 3 and 4 the apparatus comprises a floor mounted frame 20 supporting the base 1. The beam 3 supporting the shooting devices 4 extends over the whole width of the base (1) (s. FIG. 4). An essential part of base 1 is a stepwise working conveyor 21 with a plate 22 connected to rockers 23 which are pivotably mounted at the frame 20. At least two pairs of rockers are provided, whereby one pair is driven by a pneumatic or hydraulic cylinder 24. By means of this cylinder 24 the rockers 23 are movable to and fro between the inclined position of FIG. 3 and the vertical position shown with dotted lines, whereby the plate 22 is raised and moved in the direction 25. By the return stroke of the cylinder 24 and its piston, respectively, the plate 22 is lowered and moved backwards. The hide 16 is conveyed in a manner known from sewing machines.

In front of the plate 22 is mounted a stationary dish 26 and in front of this a roller 27 for leading the hide to be treated. The plate 22 is provided with a opening 28 and below this opening a holding-up member for each shooting device 4 is arranged. Each counter member consists of a pivoting lever 29, articulated at 30 on the frame 20 and provided with a supporting surface 31 for the hide at the other end. This end is engaged by a hydraulic or pneumatic driving means, raising the holding-up member through the opening 28 of the plate 22 and lowering this member (dotted in FIG. 3).

The driving means for the shooting device 4, the plate 22 and the counter member 29 are coupled by known control means in such a way that after an injection shot at first the counter members 29 are lowered into the position shown with dotted lines (FIG. 3) and then the rockers 23 are pivoted in the vertical position (dotted lines), whereby the hide 16 is moved forward by one step and an untreated strip of the hide passes under the shooting devices 4. Thereupon the counter members 29 are raised again engaging the strip of the hide to be treated and pressing it against the nozzles. At the same time the plate 22 is returned and lowered without moving the hide which is clamped between the counter member 29 and the shooting devices 4 and an injection shot by all nozzles takes place. Because the hides are of different shape and form and because every hide has a unregular surface a collecting basin is mounted below the opening 28 (not shown).

We claim:

1. Method for the manufacture of tanned hides and skins with the following steps of procedure:
   (a) Soaking of the hide,
   (b) Liming in alkaline medium,
   (c) Deliming in acid medium,
   (d) Bating by proteolytic enzymes,
   (e) Pickling by means of acids and salts,
   (f) Tanning by means of chromium -III- salts,
   (g) Retanning, and
   (h) Fatliquoring of the hide,
   wherein the solutions or liquids used in one or more of the procedure steps are introduced into the hide or skin by injection of the solutions or liquids into the hide or skin under a pressure of greater than 50 bars.

2. Method according to claim 1, wherein said pressure exceeds 100 bars.

3. Method according to claim 1, wherein said solutions or liquids are introduced into the hide in dosed quantities.

4. Method according to claim 1, wherein said solutions or liquids are introduced into different parts of the hide or skin in quantities of varying dosages.

5. Method according to claim 4, wherein said solutions or liquids are introduced in different parts of the hide such that the thicker the part of the hide, the larger the dosage introduced therein.

6. Method according to claim 1, wherein said injection is effected from the flesh side of the hide.

7. Method according to claim 1 or 6, wherein each of the solutions or liquids introduced by injection are introduced using injection means pressed against the hide.

8. Method according to claim 7, wherein said injection means for each of the solutions or liquids introduced by injection comprises nozzles.

9. Method according to claim 7, wherein said injection means for each of the solutions or liquids introduced by injection comprises a plurality of nozzles extending in rows which traverse the hide.

10. Method according to claim 9, wherein the hide is conveyed past said injection means on a conveyor means.

11. Method according to claim 10, wherein the hide on said conveyor means is positioned adjacent said injecting means and said injecting means introduces said solutions or liquids into said hide, whereby a portion of said hide has said solutions or liquids introduced therein, and then the hide is repositioned, by moving said conveyor means, so that a different portion of said hide is adjacent said injecting means, and said injecting means introduces further solutions or liquids into said hide, whereby another portion of said hide has said solutions or liquids introduced therein.

12. Method according to claim 1, wherein, after the step of fatliquoring the hide, the hide is dyed as a further step of procedure.

* * * * *